US005176009A

United States Patent [19]

Lang

[11] Patent Number: 5,176,009

[45] Date of Patent: Jan. 5, 1993

[54] STIMULATIVE EARRING FOR THE STIMULATION OF ACUPUNCTURE POINTS

[75] Inventor: Dieter Lang, Muhlacker, Fed. Rep. of Germany

[73] Assignee: Fritz E. W. Hieber, Baden-Baden, Fed. Rep. of Germany

[21] Appl. No.: 827,469

[22] Filed: Jan. 29, 1992

[51] Int. Cl.[5] ..... A44C 7/00

[52] U.S. Cl. ..... 63/14.1; 63/14.3

[58] Field of Search ..... 63/12, 13, 14.1-14.8

[56] References Cited

U.S. PATENT DOCUMENTS

| | | | |
|---|---|---|---|
| 1,262,519 | 4/1918 | Kline | 63/14.8 |
| 2,417,117 | 3/1947 | Marcus | 63/14.3 |
| 2,764,000 | 9/1956 | Lippman | 63/14.2 |
| 3,739,599 | 6/1973 | Melone | 63/13 |
| 3,990,266 | 11/1976 | Saccoccio | 63/14.5 |
| 4,704,878 | 11/1987 | Saraga | 63/14.1 |
| 4,944,164 | 7/1990 | Butler | 63/12 |

FOREIGN PATENT DOCUMENTS

| | | | |
|---|---|---|---|
| 947523 | 8/1956 | Fed. Rep. of Germany | 63/14.1 |
| 25921 | 8/1911 | United Kingdom | 63/14.8 |

*Primary Examiner*—Renee S. Luebke
*Assistant Examiner*—F. Saether
*Attorney, Agent, or Firm*—Klaus J. Bach

[57] ABSTRACT

An earring for the stimulation of acupuncture points or lines present in the human outer ear consists of a hoop-like open ended jewelry piece having opposite end portions, one being adapted to be received in the outer ear cavity and the other abutting the rear wall of the outer ear, wherein the earring consists of electrically conductive cast bronze material with an iron end piece cast into one end portion of the open-ended bronze hoop so as to provide at the opposite end portions for opposite face areas of materials which, in accordance with the electrochemical voltage series, provide for a potential therebetween when in contact with an ear which potential causes a current a flow through the ear for stimulation of the adjacent acupuncture points or lines in the outer ear.

6 Claims, 1 Drawing Sheet

STIMULATIVE EARRING FOR THE STIMULATION OF ACUPUNCTURE POINTS

BACKGROUND OF THE INVENTION

The invention relates to an earring for the stimulation of acupuncture points or lines present in the human outer ear and consisting of an essentially hoop-like bent open-ended jewelry piece of any desired shape with one of the open ends adapted to be received in the earlobe cavity and the other end being adapted to abut the rear wall of the outer ear. The ring consists of electrically conductive material and has end portions of materials which, in accordance with their location in the electrochemical voltage series, provide for an electric potential there across.

With such an earring, the different materials at the opposite open ends in contact with the ear generate, together with the acidic surface coating of the skin, a galvanic element which is capable of providing for acupuncture effects as a result of a constant flow of electricity. In this arrangement, the contact point of one end of the earring is firmly located within the external ear cavity whereas the contact point of the other end at the rear wall of the outer ear can be selected as desired. In this way, acupuncture points or lines can be reached which are not reached by the usual rings.

In accordance with the intended use, such earrings have been manufactured so far exclusively from precious metals in order to avoid any irritation of the skin contacted by the metal, particularly in order to avoid any allergic reactions. As a result such earrings are relatively expensive. In addition, the manufacture of such earrings is quite involved since the different materials had to be attached to both ends of the open-ended ring structure.

The present invention makes it possible to manufacture such earrings capable of stimulating acupuncture points and lines in a very simple manner and therefore inexpensively.

SUMMARY OF THE INVENTION

An earring for the stimulation of acupuncture points or lines in the human outer ear consists of a hoop-like open-ended jewelry piece which has opposite end portions of which one is adapted to be received in the outer ear cavity and the other to abut the rear wall of the outer ear. The earring consists of electrically conductive cast bronze material with an iron alloy end piece cast into one end portion of the open-ended bronze hoop so as to provide at the opposite end portions opposite face areas of materials which, based on the electrochemical voltage series, generate, when in contact with an ear, a potential therebetween causing current flow through the ear for stimulation of the adjacent acupuncture points or lines in the ear.

Consequently the earring no longer consists of precious metal into which different types of materials are inserted in a different work procedure, but it consists of cast bronze with an iron end piece cast into it. Casting bronze, in accordance with the invention preferably tin bronze with 15% vol. tin and additions of lead and antimony, can easily be worked and easily binds with the iron end piece during casting. Furthermore, the two materials, that is tin bronze on one side and iron on the other, are located at such a distance in the electrochemical voltage series that, together with the acidic surface coating of the skin, a current is generated which, in accordance with the opinion of acupuncture experts, is of such a magnitude that it achieves stimulation of the respective acupuncture points. This effect may be increased by providing in the opposite end faces of the open-ended hoop indentations in which sweat and other skin secretions are collected so that the acid environment necessary for generating a current flow is always present at the skin surface. The iron preferably includes alloying supplements, particularly supplements which prevent corrosion but, in any case, it should be free of nickel so as not to provoke any allergies. It has been found particularly appropriate to slightly coat the whole jewelry piece with gold in order to improve appearance of the jewelry piece and to prevent corrosion of the iron end piece during storage.

DESCRIPTION OF THE PREFERRED EMBODIMENT

Figure 1:
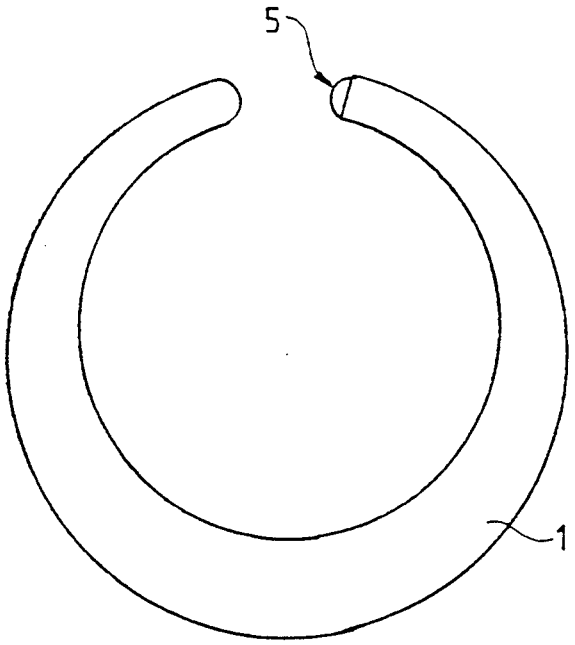
FIG. 1 shows an open-hoop shaped earring.
Figure 2:
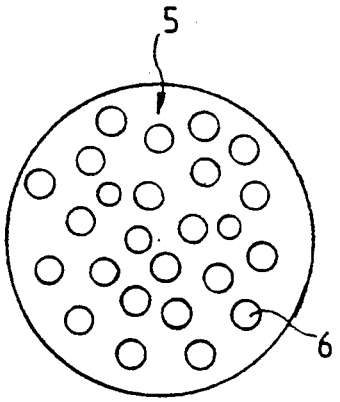
FIG. 2 shows the face area of one end.
Figure 3:
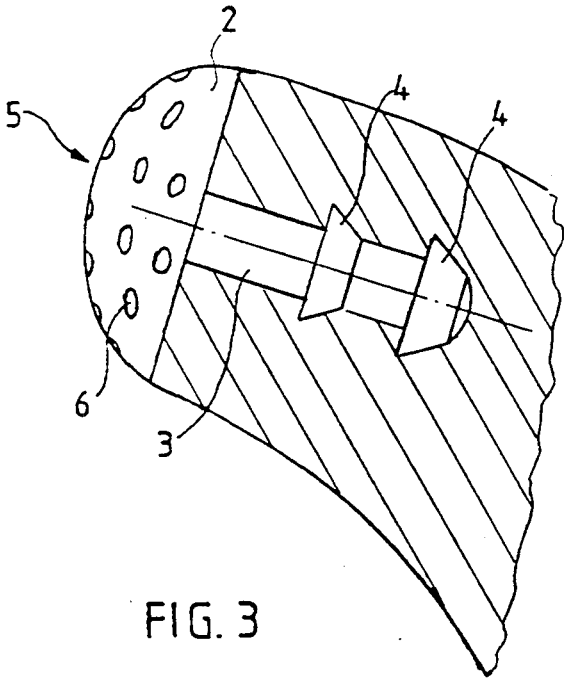
FIG. 3 is a cross-sectional view of the end with the iron end piece embedded therein.

The body of the earring shown in FIG. 1 is cast from casting bronze. During the casting procedure a mushroom-shaped end piece 2 which comprises iron is cast into the body. The endpiece 2 has a stem 3 with conical projections 4 which provide for good retention of the iron end piece 2 in the bronze material. The face area 5 of the earring body 1 is provided with indentations 6 which form reservoirs for liquid skin secretions adapted to always provide for an acid environment in the face or contact area 5 of the ring.

The bronze casting 1 may additionally have a coating of hard bronze and/or it may have a fine haze-like gold coating, on one hand to give the earring the appearance of a good jewelry piece and, on the other hand, to prevent corrosion of the iron end piece at least during storage of the earring.

What is claimed is:

1. An earring for a stimulation of acupuncture points or lines present in a human's outer ear which includes an outer ear cavity with a rear wall, said earring consisting of a hoop-like open-ended jewelry piece having two opposite end portions with one of the end portions being adapted to be received in the outer ear cavity and the other abutting the rear wall of the outer ear, said jewelry piece consisting of electrically conductive cast bronze material with an iron end piece permanently formed into only one end portion of the open-ended bronze hoop so as to provide at the opposite end portions for opposite face areas consisting of materials providing, in accordance with their locations in the electrochemical voltage series, for a potential therebetween when in contact with the surfaces of an ear.

2. An earring according to claim 1, wherein the cast bronze is a zinc-free tin bronze including about 15% vol. of tin and additions of lead and antimony.

3. An earring according to claim 1, wherein said iron end piece consists of a nickel-free iron alloy.

4. An earring according to claim 3, wherein said iron alloy is a non-oxidizing alloy.

5. An earring according to claim 1, wherein said opposite face areas have indentations formed therein.

6. An earring according to claim 1, wherein said hoop-like open-ended jewelry piece is provided with a haze-thin gold coating.

* * * * *